US006096491A

United States Patent [19]

Majumdar et al.

[11] Patent Number: 6,096,491

[45] Date of Patent: Aug. 1, 2000

[54] ANTISTATIC LAYER FOR IMAGING ELEMENT

[75] Inventors: Debasis Majumdar, Rochester; Dennis J. Eichorst, Fairport; Kenneth L. Tingler, Rochester, all of N.Y.

[73] Assignee: Eastman Kodak Company, Rochester, N.Y.

[21] Appl. No.: 09/172,844

[22] Filed: Oct. 15, 1998

[51] Int. Cl.[7] ..... G03C 1/89

[52] U.S. Cl. ..... 430/529; 430/527; 430/531

[58] Field of Search ..... 430/527, 529, 430/531

[56] References Cited

U.S. PATENT DOCUMENTS

| | | | |
|---|---|---|---|
| 2,327,828 | 8/1943 | Simmons . | |
| 3,245,833 | 4/1966 | Trevoy . | |
| 3,428,451 | 2/1969 | Trevoy . | |
| 4,070,189 | 1/1978 | Kelley et al. . | |
| 4,203,769 | 5/1980 | Guestaux | 430/527 |
| 4,237,194 | 12/1980 | Upson et al. . | |
| 4,275,103 | 6/1981 | Tsubusaki et al. | 430/67 |
| 4,394,441 | 7/1983 | Kawaguchi et al. | 430/527 |
| 4,416,963 | 11/1983 | Takimoto et al. | 430/527 |
| 4,418,141 | 11/1983 | Kawaguchi et al. | 430/527 |
| 4,431,764 | 2/1984 | Yoshizumi | 524/409 |
| 4,495,276 | 1/1985 | Takimoto et al. | 430/527 |
| 4,571,361 | 2/1986 | Kawaguchi et al. | 428/318 |
| 4,731,408 | 3/1988 | Jasne | 524/458 |
| 4,828,971 | 5/1989 | Przezdziecki | 430/527 |
| 4,987,042 | 1/1991 | Jonas et al. | 429/213 |
| 4,999,276 | 3/1991 | Kuwabara et al. | 430/527 |
| 5,006,451 | 4/1991 | Anderson et al. | 430/527 |
| 5,026,622 | 6/1991 | Yamada et al. | 430/527 |
| 5,075,171 | 12/1991 | Kondo et al. | 428/411.1 |
| 5,093,439 | 3/1992 | Epstein et al. | 525/540 |
| 5,122,445 | 6/1992 | Ishigaki | 430/527 |
| 5,219,718 | 6/1993 | Hatakeyama et al. | 430/531 |
| 5,221,598 | 6/1993 | Anderson et al. | 430/527 |
| 5,254,448 | 10/1993 | Yamada et al. | 430/527 |
| 5,284,714 | 2/1994 | Anderson et al. | 430/527 |
| 5,294,525 | 3/1994 | Yamauchi et al. | 430/527 |
| 5,300,575 | 4/1994 | Jonas et al. | 525/186 |
| 5,310,640 | 5/1994 | Markin et al. | 430/527 |
| 5,312,681 | 5/1994 | Muys et al. | 430/523 |
| 5,340,676 | 8/1994 | Anderson et al. | 430/527 |
| 5,354,613 | 10/1994 | Quintens et al. | 428/341 |
| 5,360,706 | 11/1994 | Anderson et al. | 430/530 |
| 5,366,855 | 11/1994 | Anderson et al. | 430/530 |
| 5,368,995 | 11/1994 | Christian et al. | 430/530 |
| 5,370,981 | 12/1994 | Krafft et al. | 430/527 |
| 5,372,924 | 12/1994 | Quintens et al. | 430/527 |
| 5,380,584 | 1/1995 | Anderson et al. | 430/903 |
| 5,382,494 | 1/1995 | Kudo et al. | 430/527 |
| 5,391,472 | 2/1995 | Muys et al. | 430/527 |
| 5,403,467 | 4/1995 | Jonas et al. | 205/145 |
| 5,427,835 | 6/1995 | Morrison et al. | 430/527 |
| 5,439,785 | 8/1995 | Boston et al. | 430/527 |
| 5,443,944 | 8/1995 | Krafft et al. | 430/529 |
| 5,453,350 | 9/1995 | Kurachi et al. | 430/527 |
| 5,459,021 | 10/1995 | Ito et al. | 430/527 |
| 5,466,567 | 11/1995 | Anderson et al. | 430/527 |
| 5,484,694 | 1/1996 | Lelental et al. | 430/530 |
| 5,514,528 | 5/1996 | Chen et al. | 430/530 |
| 5,529,884 | 6/1996 | Tutt et al. | 430/269 |
| 5,529,891 | 6/1996 | Wang et al. | 430/523 |
| 5,547,821 | 8/1996 | Melpolder et al. | 430/527 |
| 5,565,311 | 10/1996 | Kawamoto | 430/523 |
| 5,575,898 | 11/1996 | Wolf et al. | 205/125 |
| 5,576,163 | 11/1996 | Anderson et al. | 430/530 |
| 5,665,498 | 9/1997 | Savage et al. | 430/527 |
| 5,674,654 | 10/1997 | Zumbulyadis et al. | 430/536 |
| 5,679,505 | 10/1997 | Tingler et al. | 430/531 |
| 5,716,550 | 2/1998 | Gardner et al. | 252/500 |

FOREIGN PATENT DOCUMENTS

| | | |
|---|---|---|
| 749 040 | 12/1996 | European Pat. Off. . |
| 4055492 | 2/1992 | Japan . |

*Primary Examiner*—Richard L. Schilling
*Attorney, Agent, or Firm*—Carl F. Ruoff; Doreen M. Wells

[57] ABSTRACT

The present invention is an imaging element which includes a support, an image-forming layer superposed on the support, an electrically-conductive layer superposed on the support and a protective topcoat overlying the electrically-conductive layer. The electrically-conductive layer contains an electrically-conductive polymer and has a water electrode resistivity (WER) value that is substantially unchanged upon subjecting of the imaging element to color photographic processing. The protective topcoat is composed of a polyurethane film-forming binder having a tensile elongation to break of at least 50% and a Young's modulus measured at 2% elongation of at least 50000 psi.

11 Claims, No Drawings

ANTISTATIC LAYER FOR IMAGING ELEMENT

CROSS REFERENCE TO RELATED APPLICATIONS

This application relates to commonly assigned copending application Ser. No. 09/173,409, ABRASION RESISTANT ANTISTATIC LAYER WITH ELECTRICALLY CONDUCTING POLYMER FOR IMAGING ELEMENT filed simultaneously herewith.

FIELD OF THE INVENTION

This invention relates in general to imaging elements, such as photographic, electrostatographic, and thermal imaging elements comprising a support, an image forming layer and an electrically-conductive layer protected under an abrasion resistant topcoat; wherein the protective topcoat is comprised of a polyurethane without any cross-linking agent. More specifically, this invention relates to electrically-conductive layer(s) containing an electrically-conducting polymer with or without a polymeric binder, protected under a topcoat with a tensile elongation to break of at least 50% and a Young's modulus measured at 2% elongation of at least 50000 psi and to the use of such layers as to provide protection against the accumulation of static electrical charges before and after photographic processing and to provide a tough but flexible backing layer capable of resisting abrasion and scratching.

BACKGROUND OF THE INVENTION

Various problems associated with the generation and discharge of electrostatic charge during the manufacture and use of photographic film and paper products have been recognized for many years by the photographic industry. The accumulation of static charge on film or paper surfaces can produce irregular fog patterns in the sensitized emulsion layer(s). The presence of accumulated charge also can lead to difficulties in support conveyance as well as dust attraction to the support, which can result in repellency spots during emulsion coating, fog, desensitization, and other physical defects. The discharge of accumulated static charge during or after the application of sensitized emulsion layer (s) can produce irregular fog patterns or "static marks". The severity of static-related problems has been exacerbated greatly by increases in sensitivity of new emulsions, coating machine speeds, and post-coating drying efficiency. The generation of electrostatic charge during the film coating process results primarily from a tendency of high dielectric constant polymeric film base webs to undergo triboelectric charging during winding and unwinding operations, during conveyance through coating machines, and during finishing operations such as slitting and spooling. Static charge can also be generated during the use of the final photographic film product. In an automatic camera, winding roll film out of and back into the film cassette, especially in a low relative humidity environment, can produce static charging and result in marking. Similarly, high-speed automated film processing equipment can produce static charging that results in marking. Also, sheet films used in automated high-speed film cassette loaders (e.g., x-ray films, graphic arts films) are subject to static charging and marking.

One or more electrically-conductive antistatic layers can be incorporated into an imaging element in various ways to dissipate accumulated electrostatic charge, for example, as a subbing layer, an intermediate layer, and especially as an outermost layer either overlying the imaging layer or as a backing layer on the opposite side of the support from the imaging layer(s). A wide variety of conductive antistatic agents can be used in antistatic layers to produce a broad range of surface electrical conductivity. Many of the traditional antistatic layers used for imaging applications employ electrically-conductive materials which exhibit predominantly ionic conductivity, for example simple inorganic salts, alkali metal salts of surfactants, alkali metal ion-stabilized colloidal metal oxide sots, ionic conductive polymers or polymeric electrolytes containing alkali metal salts and the like. The electrical conductivities of such ionic conductors are typically strongly dependent on the temperature and relative humidity of the surrounding environment. At low relative humidities and temperatures, the diffusional mobilities of the charge carrying ions are greatly reduced and the bulk conductivity is substantially decreased. At high relative humidities an unprotected antistatic backing layer containing such an ionic conducting material can absorb water, swell, and soften. Especially in the case of roll films, this can result in the adhesion (viz., ferrotyping) and even physical transfer of portions of a backing layer to a surface layer on the emulsion side of the film (viz., blocking).

Antistatic layers containing electronic conductors such as conjugated conductive polymers, conductive carbon particles, crystalline semiconductor particles, amorphous semiconductive fibrils, and continuous semiconductive thin films or networks can be used more effectively than ionic conductors to dissipate charge because their electrical conductivity is independent of relative humidity and only slightly influenced by ambient temperature. Of the various types of electronic conductors disclosed in prior art, electronically-conductive metal-containing particles, such as semiconductive metal oxides, are particularly effective when dispersed with suitable polymeric binders. Antistatic layers containing granular, nominally spherical, fine particles of crystalline semiconductive metal oxides are well known and have been described extensively. Binary metal oxides doped with appropriate donor heteroatoms or containing oxygen deficiencies have been disclosed in prior art to be useful in antistatic layers for photographic elements, for example: U.S. Pat. Nos. 4,275,103; 4,416,963; 4,495,276; 4,394,441; 4,418,141; 4,431,764; 4,495,276; 4,571,361; 4,999,276; 5,122,445; 5,294,525; 5,382,494; 5,459,021; and others. Suitable claimed conductive binary metal oxides include: zinc oxide, titania, tin oxide, alumina, indium oxide, silica, magnesia, zirconia, barium oxide, molybdenum trioxide, tungsten trioxide, and vanadium pentoxide. Preferred doped conductive metal oxide granular particles include Sb-doped tin oxide, Al-doped zinc oxide, and Nb-doped titania. Additional preferred conductive ternary metal oxides disclosed in U.S. Pat. No. 5,368,995 include zinc antimonate and indium antimonate. Other suitable electrically-conductive metal-containing granular particles including metal borides, carbides, nitrides, and suicides have been disclosed in Japanese Kokai No. 04-055,492.

Antistatic backing or subbing layers containing colloidal "amorphous" vanadium pentoxide, especially silver-doped vanadium pentoxide, are described in U.S. Pat. Nos. 4,203,769 and 5,439,785. Colloidal vanadium pentoxide is composed of highly entangled microscopic fibrils or ribbons 0.005–0.01 $\mu$um wide, about 0.001 $\mu$m thick, and 0.1–1 $\mu$m in length. However, colloidal vanadium pentoxide is soluble at the high pH typical of developer solutions for wet photographic film processing and must be protected by a nonpermeable, overlying barrier layer as taught in U.S. Pat. Nos. 5,006,451; 5,221,598; 5,284,714; and 5,366,855, for example. Alternatively, a film-forming sulfopolyester latex or a polyesterionomer binder can be combined with the colloidal vanadium oxide in the conductive layer to minimize degradation during processing as taught in U.S. Pat. Nos. 5,380,584;5,427,835; 5,576,163; 5,360,706; and others.

When an electroconductive layer is the outermost layer on a support, it must be to protected against abrasion or scratching which may occur during handling of the photographic element in order to avoid degradation of its antistatic performance. Since the back side of an imaging element typically has more opportunity to come into direct contact with equipment surfaces and with mechanical parts during manufacture, winding and unwinding operations, use in a camera, processing, and printing or projecting the processed photographic element, it is particularly liable to abrasion damage or scratching. Scratches and abrasion marks not only degrade image quality during printing and projection processes but also permanently damage processed photographic film. Numerous approaches to improving the resistance of the surface or outermost layers of photographic film to scratching and abrasion damage have been described in the prior art. As one of the more effective approaches, it is well known to provide at least one protective topcoat layer overlying the antistatic layer having physical properties such as increased hardness and reduced contact friction in order to enhance resistance to scratching and abrasion.

A photographic element having a conductive layer containing semiconductive tin oxide or indium oxide particles on the opposite side of the support from the silver halide sensitized emulsion layers with a polymer-containing intermediate backing layer overlying the conductive layer and an additional protective layer overlying the backing layer is disclosed in U.S. Pat. No. 5,026,622. The outermost protective layer includes gelatin, a matting agent, a fluorine-containing anionic surfactant, and dioctyl sulfosuccinate. Another conductive three-layer backing having an antistatic layer containing granular semiconductive metal oxide particles; an intermediate backing layer containing a latex of a water-insoluble polymer, matting agent, polystyrenesulfonate sodium salt, and gelatin; and an outermost protective layer containing at least one hydrophobic polymer such as a polyester or polyurethane, fluorine-containing surfactant(s), matting agent(s), and an optional slipping aid is described in U.S. Pat. No. 5,219,718. Further, a three-layer backing having an antistatic layer including conductive metal oxide granular particles or a conductive polymer and a hydrophobic polymer latex, gelatin, and an optional hardener is overcoated with an intermediate backing layer containing gelatin, a hydrophobic polymer latex, a matting agent, and backing dyes that is simultaneously overcoated with a protective layer comprising a fluorine-containing surfactant, a matting agent, gelatin, and optionally, a polymer latex is taught in U.S. Pat. No. 5,254,448. Photographic elements including such multi-layer backings were disclosed to retain antistatic properties after processing, exhibit acceptable transport performance against Teflon coated surfaces, and have good "anti-flaw" properties.

The use of small (<15 nm) antimony-doped tin oxide particles having a high (>8 atom %) antimony dopant level and a small crystallite size (<100 Å) in abrasion resistant conductive backing layers is claimed in U.S. Pat. No. 5,484,694. A multi-element curl control layer on the backside of the support wherein the conductive layer typically is located closest to the support, with an overlying intermediate layer containing binder and antihalation dyes, and an outermost protective layer containing binder, matte, and surfactant is also claimed.

Simplified two-layer conductive backings are taught in U.S. Pat. Nos. 5,366,855; 5,382,494; 5,453,350; and 5,514,528. An antistatic layer containing colloidal silver-doped vanadium pentoxide and a vinylidene chloride-containing latex binder or a polyester ionomer dispersion coated on the opposite side of the support from the silver halide emulsion layer and subsequently overcoated with a protective layer including a coalesced layer containing both film-forming and non-film-forming colloidal polymeric particles, optional cross-linking agents, matting agents, and lubricating agents is disclosed in U.S. Pat. No. 5,366,855. Such a protective layer was also disclosed to function as an impermeable barrier to processing solutions, to resist blocking, to provide good scratch and abrasion resistance, and to exhibit excellent lubricity. However, the addition of hard polymeric particles, such as poly(methyl methacrylate), to a film-forming polymer can produce brittleness in a coated layer. A photographic element containing an aqueous-coated antistatic layer containing conductive fine particles such as metal oxide particles, a butyl acrylate-containing terpolymer latex, and optionally, a hardening agent and a surfactant that is overcoated with a solvent-coated, transparent magnetic recording layer containing preferably nitrocellulose or diacetyl cellulose as the binder and carnauba wax as a lubricant is taught in U.S. Pat. Nos. 5,382,494 and 5,453,350. Similarly, an antistatic layer containing conductive metal oxide granular particles in a hydrophilic binder applied as an aqueous or solvent dispersion and overcoated with a cellulose ester layer optionally containing ferromagnetic particles is described in U.S. Pat. No. 5,514,528. A separate lubricating overcoat layer can be optionally applied on top of the cellulose ester layer.

The inclusion of lubricant particles of a specified size, especially those having a fluorine-containing polymer, in a protective surface or backing layer containing a dispersing aid or stabilizer, a hydrophilic or resin-type binder and optionally, crosslinking agents, matting agents, antistatic agents, colloidal inorganic particles, and various other additives is described in U.S. Pat. No. 5,529,891. Photographic elements incorporating such protective layers were disclosed to exhibit improved surface scratch and abrasion resistance as evaluated on a Taber Abrader.

Another method to improve the slipperiness and scratch resistance of the back surface of a photographic element is described in U.S. Pat. No. 5,565,311. The incorporation of slipping agents containing compounds having both a long-chain aliphatic hydrocarbon moiety and a polyether moiety as a solution, emulsion or dispersion preferably in a backing protective layer containing a film-forming binder and an optional crosslinking agent overlying an antistatic layer is reported to provide improved slipperiness and scratch resistance and reduce the number of coated layers in the backing. The addition of a matting agent can improve scratch resistance as well as minimize blocking of the emulsion surface layer or emulsion-side primer layer by the backing layer. Further, the inclusion of an antistatic agent, such as conductive metal oxide particles, in a backing protective layer containing slipping and matting agents and optionally, nonionic, anionic, cationic, or betaine-type fluorine-containing surfactants is disclosed in U.S. Pat. No. 5,565,311.

An abrasion-resistant protective overcoat including a selected polyurethane binder, a lubricant, a matting agent, and a crosslinking agent overlying a conductive backing layer is described in U.S. Pat. No. 5,679,505 for motion picture print films; the abrasion-resistant protective overcoat contains a crosslinked polyurethane binder and, thus, provides a nonpermeable chemical barrier for antistatic layers containing antistatic agents that are degraded by photographic processing such as colloidal vanadium pentoxide, semiconductive metal salts (vide U.S. Pat. Nos. 3,245,833; 3,428,451 and 5,075,171), conducting polymers such as crosslinked vinylbenzyl quaternary ammonium polymers (vide U.S. Pat. No. 4,070,189) or polyanilines (vide U.S. Pat. No. 4,237,194), as suggested in U.S. Pat. No. 5,679,505. Although U.S. Pat. No. 5,679,505 can provide certain advantages over conventional carbon black containing backing layers (described in U. S. Pat. Nos. 2,271,134 and 2,327,828), the use of a crosslinking agent in the topcoat (without which the conductivity of the preferred antistatic layer of colloidal vanadium pentoxide will be jeopardized) poses some manufacturing concerns for its practice: crosslinked polyurethanes of U.S. Pat. No. 5,679,505 may impose additional constraints on the composition and pot-life of the coating solutions as well as other manufacturing parameters; from a health and safety standpoint, some crosslinking agents may require special handling and disposal procedures; removal of a crosslinked polyurethane layer can hinder recycling of the support. Although the polyurethane topcoat disclosed in U.S. Pat. No. 5,679,505 can be useful for overcoating antistatic layers containing electroconductive metal oxide granular particles which do not require protection from photographic processing solutions, the high volume loading of metal oxide particles required to obtain adequate antistatic properties can degrade the physical properties of the backing. Also, metal containing semiconductive particles, in general are quite abrasive and can cause premature damage to finishing tools, such as, knives, slitters, perforators, etc. and create undesirable dirt and debris which can adhere to the imaging element causing defects.

An electrically-conductive single layer backing having a combination of electrically-conductive fine particles, such as conductive metal oxide granular particles, and particular gelatin-coated water-insoluble polymer particles is disclosed in European Patent Application No. 749,040 to provide both a high degree of conductivity at low volumetric concentrations of conductive particles and a high degree of abrasion resistance. The use of a combination of insoluble polymer particles and a hydrophilic colloid with conductive metal oxide fine particles to prepare electrically-conductive layers that require lower volume fractions of conductive particles than conductive layers prepared using only a hydrophilic colloid as binder is disclosed in U.S. Pat. No. 5,340,676. A similar beneficial result is disclosed in U.S. Pat. No. 5,466,567 for electrically-conductive layers in which a combination of a hydrophilic colloid and pre-crosslinked gelatin particles is used as the binder for the electroconductive fine granular particles. However, the abrasion resistance of such gelatin-containing layers is unsuitable, particularly for motion picture applications.

Electrically-conductive backing layers for use in thermally processable imaging elements are described in U.S. Pat. Nos. 5,310,640 and 5,547,821. As described in U.S. Pat. No. 4,828,971, backing layers useful for thermally processable imaging elements must provide adequate conveyance properties, resistance to deformation during thermal processing, satisfactory adhesion to the support, freedom from cracking and marking, reduced electrostatic charging effects, and exhibit no sensitometric effects. The use of electrically-conductive backings and protective overcoat layers for thermally processable imaging elements is described in U.S. Pat. No. 5,310,640. In one preferred embodiment, a protective layer containing polymethylmethacrylate as binder and a polymeric matting agent is positioned overlying a conductive layer containing silver-doped vanadium pentoxide dispersed in a polymeric binder. The use of a single-layer conductive backing having antimony-doped tin oxide granular particles, a matting agent, and a polymeric film-forming binder is taught in U.S. Pat. No. 5,547,821. Another preferred embodiment teaches the use of antimony-doped tin oxide granular particles in a conductive overcoat layer overlying the imaging layer. The reported Taber abrasion test results suggest that the relative level of abrasion resistance for the single-layer backings is inferior to that for the overcoated conductive backing layer described in U.S. Pat. No. 5,310,640. Also, surface scattering and haze is higher for single-layer conductive backings than for overcoated conductive backings. Further, from the surface resistivity and dusting data reported in U.S. Pat. No. 5,547,821, it can be concluded that it is particularly difficult to simultaneously obtain low dusting and high conductivity with single-layer conductive backings containing a polyurethane binder and granular electroconductive particles.

An electrically-conductive single-layer backing for the reverse side of a laser dye-ablative imaging element comprising electrically-conductive metal-containing particles, such as antimony-doped tin oxide particles, a polymeric binder, such as gelatin or a vinylidene chloride-based terpolymer latex, a matting agent, a coating aid, and an optional hardener is described in U.S. Pat. No. 5,529,884. Surface resistivity values (≈9 log ohms/square) for the conductive backings were measured before and after the ablation process and exhibited virtually no change. No test data for abrasion or scratch resistance of the backing layers was reported.

As indicated hereinabove, the prior art for electrically-conductive backing layers and for abrasion and scratch resistant backing layers useful for imaging elements is extensive and a wide variety of multilayered backings have been disclosed. However, there is still a critical need in the art for protective backings which provide multiple functions such as electrical conductivity combined with abrasion and scratch resistance. In addition to providing electrical conductivity and abrasion and scratch resistance, backings should resist the effects of humidity change, not exhibit adverse sensitometric or photographic effects, strongly adhere to the support, exhibit low dusting, exhibit no ferrotyping or blocking behavior, provide adequate support conveyance characteristics during manufacture and use, be unaffected by photographic processing solutions, and still be manufacturable in an environmentally benign way at a reasonable cost. It is toward the objective of providing such improved electrically-conductive, abrasion and scratch resistant, backings that more effectively meet the diverse needs of imaging elements,—especially of silver halide photographic films but also of a wide range of other imaging elements—, than those of the prior art that the present invention is directed.

Electrically conducting polymers have recently received attention from various industries because of their electronic conductivity. Although many of these polymers are highly colored and are less suited for photographic applications, some of these electrically conducting polymers, such as substituted or unsubstituted pyrrole-containing polymers (as mentioned in U.S. Pat. Nos. 5,665,498 and 5,674,654), substituted or unsubstituted thiophene-containing polymers (as mentioned in U.S. Pat. Nos. 5,300,575; 5,312,681; 5,354,613; 5,370,981; 5,372,924; 5,391,472; 5,403,467; 5,443,944; 5,575,898; 4,987,042 and 4,731,408) and substituted or unsubstituted aniline-containing polymers (as mentioned in U.S. Pat. Nos. 5,716,550 and 5,093,439) are transparent and not prohibitively colored, at least when coated in thin layers at moderate coverage. Because of their electronic conductivity instead of ionic conductivity, these polymers are conducting even at low humidity. Moreover, these polymers can retain sufficient conductivity even after wet chemical processing to provide what is known in the art as "process-surviving" antistatic characteristics to the photographic support they are applied. Unlike metal-containing semiconducting particulate antistatic materials (e.g., antimony-doped tin oxide), the aforementioned electrically conducting polymers are less abrasive, environmentally more acceptable (due to absence of heavy metals), and, in general, less expensive.

However, it has been reported (U.S. Pat. No. 5,354,613) that the mechanical strength of a thiophene-containing polymer layer is not sufficient and can be easily damaged without an overcoat. Protective layers such as poly(methyl methacrylate) can be applied on such thiophene-containing antistat layers but these protective layers typically are coated out of organic solvents and therefore not highly desired. More over, these protective layers may be too brittle to be an external layer for certain applications, such as motion picture print films (as illustrated in U.S. Pat. No. 5,679,505). Use of aqueous polymer dispersions (such as vinylidene chloride, styrene, acrylonitrile, alkyl acrylates and alkyl methacrylates) has been taught in U.S. Pat. No. 5,312,681 as an overlying barrier layer for thiophene-containing antistat layers, and onto the said overlying barrier layer is adhered a hydrophilic colloid-containing layer. But, again, the physical properties of these barrier layers may preclude their use as an outermost layer in certain applications. The use of a thiophene-containing outermost antistatic layer has been taught in U.S. Pat. No. 5,354,613 wherein a hydrophobic polymer with high glass transition temperature is incorporated in the antistat layer. But these hydrophobic polymers reportedly may require organic solvent(s) and/or swelling agent(s) "in an amount of at least 50% by weight" of the polythiophene, for coherence and film forming capability.

As will be demonstrated hereinbelow, the present invention can provide an antistatic layer with a protective topcoat without the use of any crosslinking agent, to an imaging element, incorporating humidity independent, process-surviving antistatic characteristics as well as resistance to abrasion and scratching. Specifically, the present invention provides an antistatic layer comprising an electrically conducting polymer with or without a suitable film forming binder, and a polyurethane topcoat wherein the polyurethane has a tensile elongation to break of at least 50% and a Young's modulus measured at 2% elongation of at least 50000 psi, with certain advantages over the teachings of the prior art.

SUMMARY OF THE INVENTION

The present invention is an imaging element which includes a support, an image-forming layer superposed on the support, an electrically-conductive layer superposed on the support and a protective topcoat overlying the electrically-conductive layer. The electrically-conductive layer contains an electrically-conductive polymer. The protective topcoat is composed of a polyurethane film-forming binder having a tensile elongation to break of at least 50% and a Young's modulus measured at 2% elongation of at least 50000 psi.

DETAILED DESCRIPTION OF THE INVENTION

The present invention comprises a support, at least one image forming layer and at least one electrically-conductive layer protected under an abrasion resistant topcoat; wherein the protective topcoat is comprised of a polyurethane without any cross-linking agent. More specifically, this invention relates to electrically-conductive layer(s) containing an electrically-conducting polymer with or without a polymeric binder, protected under a topcoat of polyurethane with a tensile elongation to break of at least 50% and a Young's modulus measured at 2% elongation of at least 50000 psi and to the use of such layers as to provide protection against the accumulation of static electrical charges before and after photographic processing and to provide a tough but flexible backing layer capable of resisting abrasion and scratching.

The present invention provides an electrical resistivity of less than 11 log ohms/ square, but preferably less than 10 log ohms/ square, and more preferably less than 9 log ohms/ square, before and after undergoing typical color photographic film processing.

The specific criteria for scratch and abrasion resistant antistatic backings for imaging elements such as motion picture print films have been addressed in U.S. Pat. No. 5,679,505. The present invention not only fulfills these requirements, but also provides key advantages over some of the prior art (e.g., U.S. Pat. No. 5,679,505), by eliminating the need for a crosslinking agent in the polyurethane topcoat and reducing its overall thickness, and thus simplifying the manufacturing process and reducing the cost of manufacturing such imaging elements.

The present invention provides an imaging element for use in an image-forming process comprising (1) a support, (2) at least one light- or heat-sensitive imaging layer, (3) at least one transparent electrically-conductive layer, wherein the electrically-conductive layer is comprised of an electrically conducting polymer, such as substituted or unsubstituted pyrrole-containing polymers (as mentioned in U.S. Pat. Nos. 5,665,498 and 5,674,654), substituted or unsubstituted thiophene-containing polymers (as mentioned in U.S. Pat. Nos. 5,300,575; 5,312,681; 5,354,613; 5,370,981; 5,372,924; 5,391,472; 5,403,467; 5,443,944; 5,575,898; 4,987,042 and 4,731,408) and substituted or unsubstituted aniline-containing polymers (as mentioned in U.S. Pat. Nos. 5,716,550 and 5,093,439) with or without a film-forming binder, and (4) at least one protective topcoat comprising a polyurethane having a tensile elongation to breaking of at least 50% and a Young's modulus measured at 2% elongation of at least 50,000 lb/in$^2$. Furthermore, the protective topcoat does not require a crosslinking agent. The protective topcoat may optionally comprise a lubricating agent, a matting agent, coating aid and other addenda.

The layers as per this invention can be incorporated in many different types of imaging elements including, for example, photographic, thermographic, electrothermographic, photothermographic, dielectric recording, dye migration, laser dye-ablation, thermal dye transfer, electrostatographic, and electrophotographic imaging elements. Detailed descriptions of the composition and function of this wide variety of different imaging elements are provided in U.S. Pat. No. 5,368,995. Further details with respect to the composition and function of a wide variety of different imaging elements are provided in U.S. Pat. No. 5,300,676 and references described therein which are incorporated herein by reference. All of the imaging processes described in the '676 patent, as well as many others, have in common the use of an electrically-conductive layer as an electrode or as an antistatic layer. The requirements for a useful electrically-conductive layer in an imaging environment are extremely demanding and thus the art has long sought to develop improved electrically-conductive layers exhibiting the necessary combination of physical, optical and chemical properties.

Photographic elements that can be provided with an electrically-conductive backing in accordance with this invention can differ widely in structure and composition. For example, they can vary greatly with regard to the type of support, the number and composition of the image-forming layers, and the number and types of auxiliary layers that are included in the elements. In particular, photographic elements can be still films, motion picture films, x-ray films, graphic arts films, paper prints or microfiche films, especially CRT-exposed autoreversal and computer output microfiche films. They can be black-and-white elements, color elements adapted for use in a negative-positive process or color elements adapted for use in a reversal process. The image-forming layer or layers of the element typically comprise a radiation-sensitive agent, e.g., silver halide, dispersed in a hydrophilic water-permeable colloid. Suitable hydrophilic vehicles include both naturally-occurring substances such as proteins, for example, gelatin, gelatin derivatives, cellulose derivatives, polysaccharides such as dextran, gum arabic, and the like, and synthetic polymeric substances such as water-soluble polyvinyl compounds like poly(vinylpyrrolidone), acrylamide polymers, and the like. A particularly common example of an image-forming layer is a gelatin-silver halide emulsion layer. The silver halide photographic material according to the present invention may have a magnetic recording layer for recording various kinds of information.

The conductive layer and superposed protective layer of this invention can be incorporated in various types of imaging elements for specific imaging applications such as color negative films, color reversal films, black-and-white films, color and black-and-white papers, electrophotographic media, as well as thermally processable imaging elements including thermographic and photothermographic media, thermal dye transfer elements, laser dye ablation elements, laser toner fusion media, and the like. Suitable photosensitive image-forming layers are those which provide color or black and white images. Such photosensitive layers can be image-forming layers containing silver halides such as silver chloride, silver bromide, silver bromoiodide, silver chlorobromide and the like. Both negative and reversal silver halide elements are contemplated. For reversal films, the emulsion layers described in U.S. Pat. No. 5,236,817, especially examples 16 and 21, are particularly suitable. Any of the known silver halide emulsion layers, such as those described in *Research Disclosure*, Vol. 176, Item 17643 (December, 1978) and *Research Disclosure*, Vol. 225, Item 22534 (January, 1983), and *Research Disclosure*, Item 36544 (September, 1994), and *Research Disclosure*, Item 37038 (February, 1995) are useful in preparing photographic elements in accordance with this invention.

Photographic elements having conductive backing layers of this invention can be either simple black-and-white or monochrome elements or multilayer and /or multicolor elements. Generally, the photographic element is prepared by coating the film support on the side opposite the conductive backing layer with one or more photosensitive image-forming layers comprising a dispersion of silver halide crystals in an aqueous solution of gelatin and optionally one or more subbing layers. The coating process can be carried out on a continuously operating coating machine wherein a single layer or a plurality of layers are applied to the support. For multicolor elements, layers can be coated simultaneously on the composite film support as described in U.S. Pat. Nos. 2,761,791 and 3,508,947. Additional useful coating and drying procedures are described in *Research Disclosure*, Vol. 176, Item 17643 (December, 1978).

Conductive layers and protective layers in accordance with this invention can be applied to a variety of supports. Such supports can be either transparent or opaque (reflective). Transparent support materials used in the practice of this invention may be comprised of any of a wide variety of synthetic high molecular weight polymeric films such as cellulose esters including cellulose diacetate, cellulose triacetate, cellulose acetate butyrate, cellulose propionate; cellulose nitrate; polyesters such as poly(ethylene terephthalate), poly(ethylene naphthalate), polycarbonate; poly(vinyl acetal); polyolefins such as polyethylene, polypropylene; polystyrene; polyacrylates; and others; and blends or laminates of the above polymers. Transparent film supports can be either colorless or colored by the addition of a dye or pigment. Suitable opaque or reflective supports comprise paper, polymer-coated paper, including polyethylene-, polypropylene-, and ethylene-butylene copolymer-coated or laminated paper, synthetic papers, and pigment-containing polyesters and the like. Of these support materials, films of cellulose triacetate, poly(ethylene terephthalate), and poly(ethylene naphthalate) prepared from 2,6-naphthalene dicarboxylic acids or derivatives thereof are preferred. The thickness of the support is not particularly critical. Support thicknesses of 2 to 10 mils (50 $\mu$m to 254 $\mu$m) are suitable for photographic elements in accordance with this invention.

In order to promote adhesion between the conductive backing layer of this invention and the support, the support can be surface-treated by various processes including corona discharge, glow discharge, UV exposure, flame treatment, electron-beam treatment, as described in U.S. Pat. No. 5,718,995 or treatment with adhesion-promoting agents including dichloro- and trichloro-acetic acid, phenol derivatives such as resorcinol and p-chloro-m-cresol, solvent washing or overcoated with adhesion promoting primer or tie layers containing polymers such as vinylidene chloride-containing copolymers, butadiene-based copolymers, glycidyl acrylate or methacrylate-containing copolymers, maleic anhydride-containing copolymers, condensation polymers such as polyesters, polyamides, polyurethanes, polycarbonates, mixtures and blends thereof, and the like.

In the case of photographic elements for direct or indirect x-ray applications, the antistatic layer can be applied as a subbing layer on either side or both sides of the film support. In one type of photographic element, the antistatic subbing layer is applied to only one side of the film support and the sensitized emulsion coated on both sides of the film support. Another type of photographic element contains a sensitized emulsion on only one side of the support and a pelloid containing gelatin on the opposite side of the support. An antistatic layer can be applied under the sensitized emulsion or, preferably, the pelloid. Additional optional layers can be present. In another photographic element for x-ray applications, an antistatic subbing layer can be applied either under or over a gelatin subbing layer containing an antihalation dye or pigment. Alternatively, both antihalation and antistatic functions can be combined in a single layer containing conductive particles, antihalation dye, and a binder. This hybrid layer can be coated on one side of a film support under the sensitized emulsion.

The antistatic layer or layers of the present invention can be applied to the support in various configurations depending upon the requirements of the specific application. In the case of photographic elements, an antistatic layer can be applied to a polyester film base during the support manufacturing process after orientation of the cast resin on top of a polymeric undercoat layer. The antistatic layer can be applied as a subbing layer under the sensitized emulsion, on the side of the support opposite the emulsion or on both sides of the support. Alternatively, it can be applied between emulsion layers on either or both sides of the support. When the antistatic layer is applied as a subbing layer under the sensitized emulsion, it is not necessary to apply any intermediate layers such as barrier layers or adhesion promoting layers between it and the sensitized emulsion, although they can optionally be present. Alternatively, the antistatic layer can be applied as part of a multi-component curl control layer on the side of the support opposite to the sensitized emulsion. The antistatic layer would typically be located closest to the support. An intermediate layer, containing primarily binder and antihalation dyes functions as an antihalation layer. The outermost layer containing polyurethane binder, matte, lubricant and surfactants functions as a protective overcoat.

The antistatic layer may be used in a multilayer backing which is applied to the side of the support opposite to the sensitized emulsion. Such backing layers, which typically provide friction control and scratch, abrasion, and blocking resistance to imaging elements are commonly used, for example, in films for consumer imaging, motion picture imaging, business imaging, and others. In the case of backing layer applications, the antistatic layer is superposed with a polyurethane topcoat with appropriate physical properties. The antistatic layer may also be superposed with other optional auxilliary layers such as a lubricant layer, and/or an alkali- removable carbon black-containing layer (as described in U.S. Pat. Nos. 2,271,234 and 2,327,828), for antihalation and camera-transport properties, a magnetic recording layer, for example, and/or any other layer(s) for other functions.

In the case of photographic imaging elements, the electrically-conductive layer of this invention is located preferably on the side of the support opposite the sensitized emulsion layer(s) and may overlie an optional subbing layer. The antistatic layer together with the protective polyurethane topcoat function both to dissipate electrostatic charge resulting from triboelectric charging of the imaging element and to protect the imaging element from damage due to abrasion and scratching which may take place during manufacturing, use or processing of the imaging element. The electrical conductivity of the conductive layer of this invention is nominally independent of relative humidity. Further, electrical conductivity is not appreciably degraded by exposure to aqueous solutions exhibiting a wide range of pH values (e.g., $2 \leqq pH \leqq 13$) as are commonly used in photographic processing.

A preferred use of the present invention is for application in motion picture print films. In this regard, the present invention is directly applicable to all embodiments of the invention of U.S. Pat. No. 5,679,505, with the added benefit of not requiring the use of a crosslinking agent. In other words, the various embodiments of the present invention can be the same but not limited to those disclosed in U.S. Pat. No. 5,679,505 incorporated in its entirety herein by reference.

The antistatic layer of the present invention comprises an electrically-conducting polymer, specifically an electronically-conducting polymer chosen from any or a combination of electrically-conducting polymers, such as substituted or unsubstituted pyrrole-containing polymers (as mentioned, for example, in U.S. Pat. Nos. 5,665,498 and 5,674,654), substituted or unsubstituted thiophene-containing polymers (as mentioned, for example, in U.S. Pat. Nos. 5,300,575; 5,312,681; 5,354,613; 5,370,981; 5,372,924; 5,391,472; 5,403,467; 5,443,944; 5,575,898; 4,987,042 and 4,731,408) and substituted or unsubstituted aniline-containing polymers (as mentioned, for example, in U.S. Pat. Nos. 5,716,550 and 5,093,439). The electrically conducting polymer may be soluble or dispersible in organic solvents or water or mixtures thereof. For environmental reasons, aqueous systems are preferred. Polyanions used in the synthesis of these electrically conducting polymers are the anions of polymeric carboxylic acids such as polyacrylic acids, polymethacrylic acids or polymaleic acids and polymeric sulfonic acids such as polystyrenesulfonic acids and polyvinylsulfonic acids, the polymeric sulfonic acids being those preferred for this invention. These polycarboxylic and polysulfonic acids may also be copolymers of vinylcarboxylic and vinylsulfonic acids with other polymerizable monomers such as the esters of acrylic acid and styrene. The molecular weight of the polyacids providing the polyanions preferably is 1,000 to 2,000,000, particularly preferably 2,000 to 500,000. The polyacids or their alkali salts are commonly available, e.g., polystyrenesulfonic acids and polyacrylic acids, or they may be produced based on known methods. Instead of the free acids required for the formation of the electrically conducting polymers and polyanions, mixtures of alkali salts of polyacids and appropriate amounts of monoacids may also be used. Preferred electrically conducting polymers for the present invention include polypyrrole styrene sulfonate (referred to as polypyrrole/poly (styrene sulfonic acid) in U.S. Pat. No. 5,674,654), 3,4-dialkoxy substituted polypyrrole styrene sulfonate, and 3,4-dialkoxy substituted polythiophene styrene sulfonate. The most preferred substituted electrically conductive polymers include poly(3,4-ethylene dioxypyrrole styrene sulfonate) and poly(3,4-ethylene dioxythiophene styrene sulfonate).

Any polymeric film-forming binder, including water soluble polymers, synthetic latex polymers such as acrylics, styrenes, acrylonitriles, vinyl halides, butadienes, and others, or water dispersible condensation polymers such as polyurethanes, polyesters, polyester ionomers, polyamides, epoxides, and the like, may be optionally employed in the antistatic layer to improve integrity of the antistatic layer and to improve adhesion of the antistatic layer to any underlying and/or overlying layer(s). Preferred binders include polyester ionomers, vinylidene chloride containing interpolymers and sulfonated polyurethanes as disclosed in application Ser. No. 09/172,878 incorporated herein by reference The electrically conducting polymer to binder weight ratio can vary from 100:0 to 0.1:99.9, and the dry coverage of the antistatic layer can vary from 1 $mg/m^2$ to 5 $g/m^2$. The antistatic coating formulation may also contain a coating aid to improve coatability. The common level of coating aid in the antistatic coating formula is 0.01 to 0.3 weight % active coating aid based on the total solution weight. These coating aids are typically either anionic or nonionic and can be chosen from many that are applied for aqueous coating. The various ingredients of the coating solution may benefit from pH adjustment prior to mixing, to insure compatibility. Commonly used agents for pH adjustment are ammonium hydroxide, sodium hydroxide, potassium hydroxide, tetraethyl amine, sulfuric acid, acetic acid, etc.

The antistatic layer of the present invention is overcoated with a polyurethane, preferably an aliphatic polyurethane chosen for its excellent thermal and UV stability and freedom from yellowing. The polyurethanes, suitable for the present invention, are those having a tensile elongation to break of at least 50% and a Young's modulus measured at an elongation of 2% of at least 50000 psi. As per U.S. Pat. No. 5,679,505, these physical property requirements insure that the antistatic layer is hard yet tough enough to simultaneously provide excellent abrasion resistance and outstanding resiliency, in applications such as motion picture print films which need to survive hundreds of cycles through motion picture projectors. Examples and details of these specific polyurethanes are mentioned in U.S. Pat. No. 5,679,505 and references therein. The polyurethane topcoat is preferably coated at a dry coverage of from about 50 mg/m$^2$ to 5 g/m$^2$. The polyurethane topcoat may contain coating aid, lubricant, matting agents and other addenda as discussed in U.S. Pat. No. 5,679,505 and references therein.

The antistatic and the polyurethane topcoat coating compositions of the present invention can be applied to the aforementioned supports of the imaging element by any of a variety of well-known coating methods. Handcoating techniques include using a coating rod or knife or a doctor blade. Machine coating methods include hopper coating, skim pan/air knife coating, roller coating, gravure coating, curtain coating, bead coating, slide coating, extrusion coating, spin coating and the like. Alternatively, the antistatic layer or layers of the present invention can be applied to a single or multilayered polymeric web by any of the aforementioned methods, and the said polymeric web can subsequently be laminated (either directly or after stretching) to a film or paper support of an imaging element (such as those discussed above) by extrusion, calendering or any other suitable method.

In addition to components mentioned above, other components that are well known in the photographic art may also be present in any of the layers of the invention. These additional components include: co-binders, thickeners, coalescing aids, soluble and/or solid particle dyes, antifoggants, charge control agents, biocides and others.

It is well-known to include at least one of a wide variety of surfactants or coating aids in an outermost protective layer overlying the emulsion layer(s) or in an outermost backing layer as charge control agents to help dissipate accumulated electrostatic charge or prevent charging. A wide variety of ionic-type surfactants have been evaluated as charge control agents including anionic, cationic, and betaine-based surfactants of the type described, for example, in U.S. patent application Ser. Nos. 08/991,288 and 08/991,493 filed Dec. 16, 1997.

The present invention is further illustrated by the following examples of its practice. However, the scope of this invention is by no means restricted to these specific examples.

SAMPLE PREPARATION

Electrically Conducting Polymer

The electrically conducting polymer in the following working examples is derived from an aqueous dispersion of a commercially available thiophene-containing polymer supplied by Bayer Corporation as Baytron P. This electrically conducting polymer is based on an ethylene dioxythiophene and is henceforth referred to as EDOT.

Binders

The binders used for the electrically conducting polymer in the antistatic layer in the following examples include commercially available polymeric dispersions in water: AQ55D, a polyester ionomer supplied by Eastman Chemicals and Bayhydrol PR 240, a sulfonated polyurethane supplied by Bayer Corporation.

Polyurethane Topcoat

The polyurethane topcoat is derived from an aqueous anionic dispersion Witcobond 232, supplied by Witco Corporation. As mentioned in U.S. Pat. No. 5,679,505, this polyurethane fulfills the criteria of tensile elongation to break of at least 50% and a Young's modulus measured at an elongation of 2% of at least 50000 psi, as required by the present invention.

Coating Aid

The coating aid used for the antistatic layer is Pluronic F 88, supplied by BASF Corporation, and that used for the polyurethane topcoat is Triton X-100, supplied by Rohm and Haas.

Film Based Support

Poly(ethylene terephthalate) or PET film base that had been previously coated with a subbing layer of vinylidene chloride-acrylonitrile-acrylic acid terpolymer latex was used as the web on which aqueous coatings were applied by hopper coating method. The coatings were dried between 80° C. and 125° C. The coating coverage varied between 300 mg/m$^2$ and 1000 mg/m$^2$ when dried.

TEST METHODS

Internal resistivity or "water electrode resistivity" (WER) was measured by the procedures described in R. A. Elder, "Resistivity Measurements on Buried Conductive Layers", EOS/ESD Symposium proceedings, September 1990, pages 251–254. WER values of various samples were measured before and after a typical color photographic processing, namely C-41 processing.

Dry adhesion was evaluated by scribing a small cross-hatched region into the coating with a razor blade. A piece of high-tack adhesive tape was placed over the scribed region and quickly removed. The relative amount of coating removed is a qualitative measure of the dry adhesion.

Taber abrasion tests were performed in accordance with the procedures set forth in ASTM D1044.

WORKING EXAMPLES

Samples 1–10 were prepared on subbed PET as per the present invention at various dry coverages of the antistatic layer, with EDOT as the electrically conducting polymer and with or without any binder; wherein the antistatic layers were overcoated with Witcobond 232 polyurethane topcoat at a dry coverage of 500 mg/m$^2$ without any crosslinking agent. All these samples contained a small amount of the indicated coating aids. Details about the composition and nominal dry coverage of these samples 1–10 and the corresponding WER values before and after C-41 color photographic processing are provided in the following table. All samples showed excellent dry adhesion.

It is clear that all samples 1–10 prepared as per the present invention with EDOT as the electrically conducting polymer and Witcobond 232 as the polyurethane topcoat with the specified mechanical properties, have excellent conductivity before and after C-41 processing and, thus, are effective as "process-surviving" antistatic layers. Note that as per the present invention, no crosslinking agent was required in the polyurethane topcoat.

In order to assess the abrasion resistance of the polyurethane topcoat prepared without any crosslinking agent, as per the present invention, Taber tests were performed. It was found that for the same nominal dry coverage, a layer of Witcobond 232 without any crosslinking agent, as per the present invention, resulted in the same Taber haze value as a layer of Witcobond 232 with 6 weight % of Neocryl CX 100 (a polyfunctional aziridine crosslinking agent from Zeneca Corporation), as per U.S. Pat No. 5,679,505. This clearly demonstrates that the polyurethane topcoat without any crosslinking agent, as per the present invention, should provide the same level of abrasion resistance as a topcoat with a crosslinking agent, preferred as per the teachings of U.S. Pat No. 5,679,505.

COMPARATIVE SAMPLES

Samples, Comp. 1–3, were prepared on subbed PET wherein for all three samples the antistatic layers were coated as per the preferred formulation disclosed in U.S. Pat. No. 5,679,505 comprising a vanadium pentoxide ($V_2O_5$) based colloid and a polyesterionomer binder AQ29D (supplied by Eastman Chemicals). The polyurethane topcoat was Witcobond 232, at a dry coverage of 500 mg/m$^2$ without any crosslinking agent for Comp. 1 The polyurethane topcoat was Witcobond 232, at a dry coverage of 500 mg/m$^2$ with 5 weight % of Neocryl CX-100 (a polyfunctional aziridine crosslinking agent from Zeneca Corporation) for Comp. 2. The polyurethane topcoat was Witcobond 232, at a dry coverage of 1000 mg/m without any crosslinking agent for Comp. 3. Details about the composition and nominal dry coverage of these s Comp. 1–3 and the corresponding WER values before and after C-41 color photographic processing are provided in the following table.

| Sample | Antistatic layer composition | Nominal dry coverage of antistatic layer mg/m$^2$ | Topcoat | Crosslinking agent in topcoat | Nominal dry coverage of topcoat mg/m$^2$ | WER before processing log ohms/square | WER after C-41 processing log ohms/square |
|---|---|---|---|---|---|---|---|
| 1 | EDOT: binder 100:0 | 10 | Witco 232 | none | 500 | 7.6 | 7.2 |
| 2 | EDOT: binder 100:0 | 20 | Witco 232 | none | 500 | 7.4 | 7.0 |
| 3 | EDOT: AQ55D 10:90 | 150 | Witco 232 | none | 500 | 7.3 | 7.2 |
| 4 | EDOT: AQ55D 10:90 | 300 | Witco 232 | none | 500 | 7.2 | 6.9 |
| 5 | EDOT: AQ55D 20:80 | 75 | Witco 232 | none | 500 | 7.2 | 7.1 |
| 6 | EDOT: AQ55D 30:70 | 75 | Witco 232 | none | 500 | 7.0 | 6.9 |
| 7 | EDOT: PR 240 5:95 | 300 | Witco 232 | none | 500 | 7.8 | 7.7 |
| 8 | EDOT: PR 240 10:90 | 300 | Witco 232 | none | 500 | 7.4 | 7.3 |
| 9 | EDOT: PR 240 10:90 | 150 | Witco 232 | none | 500 | 7.6 | 7.6 |
| 10 | EDOT: PR 240 10:90 | 150 | Witco 232 | none | 500 | 7.2 | 7.1 |
| Comp. 1 | $V_2O_5$: AQ29D 50:50 | 12 | Witco 232 | none | 500 | 7.8 | 11.6 |
| Comp. 2 | $V_2O_5$: AQ29D 50:50 | 12 | Witco 232 | CX100 | 500 | 7.8 | 8.6 |
| Comp. 3 | $V_2O_5$: AQ29D 50:50 | 12 | Witco 232 | none | 1000 | 8.6 | 9.6 |

It is clear that Comp. 1–3, gain substantially in their WER values after C-41 processing, indicating loss of post-processing conductivity of the antistatic layers, prepared as per the preferred examples of U.S. Pat. No. 5,679,505. For the same dry coverage (500 mg/m$^2$) of the topcoat without any cross-linking agent, the WER value of the antistatic layer of Comp. 1, per U.S. Pat. No. 5,679,505, increased by almost four orders of magnitude, after C-41 processing, whereas none of the samples prepared as per the present invention suffered any significant change in WER. Doubling the thickness of the topcoat, as in Comp. 3 or incorporating a crosslinking agent in the topcoat, as in Comp. 2, reduced the processing-induced change in the conductivity of the antistatic layer but in all cases the samples of the present invention provided superior post-processing WER values without the use of any crosslinking agent and consequently resulted in improved manufacturability.

The invention has been described in detail with particular reference to certain preferred embodiments thereof, but it will be understood that variations and modifications can be effected within the spirit and scope of the invention.

What is claimed is:

1. An imaging element comprising:

a support;

an image-forming layer superposed on the support;

an electrically-conductive layer superposed on the support; said electrically-conductive layer comprising 3,4-dialkoxysubstituted polythiophene styrene sulfonate; and a protective topcoat overlying the electrically-conductive layer, said topcoat comprising a non-crosslinked aliphatic polyurethane film-forming binder having a tensile elongation to break of at least 50% and a Young's modulus measured at 2% elongation of at least 50000 psi;

wherein said electrically-conductive layer has a water electrode resistivity (WER) value that is substantially unchanged upon subjecting of said imaging element to color photographic processing.

2. The imaging element of claim 1 wherein the support is selected from the group consisting of cellulose esters, polyesters, polyolefins, paper and polymer-coated paper.

3. The imaging element of claim 1 wherein said electrically-conductive layer comprises a dry coverage of about 10 mg/m$^2$ to 300 mg/m$^2$ and said polyurethane in said topcoat comprises a dry coverage of about 500 mg/m$^2$.

4. The imaging element of claim 1 wherein the electrically-conducting layer further comprises a polymeric film-forming binder selected from the group consisting of water soluble polymers, synthetic latex polymers and water dispersible condensation polymers.

5. The imaging element of claim 4 wherein the electronically-conductive polymer to binder weight ratio is from 100:0 to 0.1:99.9.

6. The imaging element of claim 1 wherein the electrically-conducting layer comprises a dry coverage of from 1 mg/m$^2$ to 5 g/m$^2$.

7. The imaging element of claim 1 wherein the electrically-conducting layer further comprises a coating aid.

8. The imaging element of claim 1 wherein the electrically-conducting layer further comprises co-binders, thickeners, coalescing aids, particle dyes, antifoggants, charge control agents or biocides.

9. The imaging element of claim 1 wherein the protective topcoat further comprises co-binders, thickeners, coalescing aids, matting agents, lubricants, particle dyes, antifoggants, charge control agents or biocides.

10. The imaging element of claim 1 wherein said water electrode resistivity (WER) value is less than 9 log ohms/square.

11. The imaging element of claim 1 wherein said polyurethane in said topcoat comprises a dry coverage of about 50 mg/m$^2$ to 5 g/m$^2$.

* * * * *